US008879146B2

(12) United States Patent
LoRocco et al.

(10) Patent No.: US 8,879,146 B2
(45) Date of Patent: Nov. 4, 2014

(54) REFLECTIVE DOT SIGHTING DEVICE WITH PERCEIVED DOT LOCATION

(75) Inventors: Paul LoRocco, Dallas, TX (US); John Estridge, Plano, TX (US)

(73) Assignee: TruGlo, Inc., Richardson, TX (US)

( * ) Notice: Subject to any disclaimer, the term of this patent is extended or adjusted under 35 U.S.C. 154(b) by 1334 days.

(21) Appl. No.: 12/570,507

(22) Filed: Sep. 30, 2009

(65) Prior Publication Data

US 2010/0077645 A1 Apr. 1, 2010

Related U.S. Application Data

(60) Provisional application No. 61/101,258, filed on Sep. 30, 2008.

(51) Int. Cl.

| | |
|---|---|
| ***G02B 23/10*** | (2006.01) |
| ***F41G 1/467*** | (2006.01) |
| ***F41G 1/30*** | (2006.01) |

(52) U.S. Cl.

CPC . *F41G 1/30* (2013.01); *F41G 1/467* (2013.01)
USPC ..... 359/362; 42/113; 124/87

(58) Field of Classification Search

USPC ..... 359/399, 428, 433, 630, 839, 362; 42/111, 119, 113, 122, 130–132, 123; 33/227, 229, 263, 265, 297; 124/87

See application file for complete search history.

(56) References Cited

U.S. PATENT DOCUMENTS

| | | | | |
|---|---|---|---|---|
| 2,780,130 | A | 2/1957 | Mauer | |
| 3,942,901 | A * | 3/1976 | Ekstrand | 356/251 |
| 4,346,995 | A | 8/1982 | Morris | |
| 4,658,139 | A * | 4/1987 | Brennan et al. | 250/330 |
| 5,090,805 | A | 2/1992 | Stawarz | |
| 5,205,044 | A | 4/1993 | DePaoli | |
| 5,383,278 | A | 1/1995 | Kay | |
| 5,653,034 | A | 8/1997 | Bindon | |
| 5,813,159 | A * | 9/1998 | Kay et al. | 42/113 |
| 6,807,742 | B2 | 10/2004 | Schick et al. | |
| 6,967,775 | B1 * | 11/2005 | Millett | 359/399 |
| 7,234,265 | B1 * | 6/2007 | Cheng et al. | 42/113 |
| 7,574,810 | B1 * | 8/2009 | LoRocco | 33/265 |
| 7,814,669 | B2 * | 10/2010 | Kingsbury | 33/265 |
| 2005/0091900 | A1 * | 5/2005 | Tippmann | 42/76.01 |
| 2007/0180751 | A1 * | 8/2007 | Joannes | 42/113 |
| 2009/0139100 | A1 * | 6/2009 | Kingsbury | 33/265 |
| 2009/0193705 | A1 * | 8/2009 | LoRocco | 42/123 |

* cited by examiner

*Primary Examiner* — Stephone B Allen
*Assistant Examiner* — James McGee
(74) *Attorney, Agent, or Firm* — Alvin R. Wirthlin

(57) ABSTRACT

A reflective sighting device includes a reflective sight component having a reflective surface for facing a user and a light source arranged for projecting a reflected image onto the reflective sight component for view by the user along a line of sight. A first focal plane of the reflected image is closer to the reflective sight component than a second focal plane of a distant target, so that movement of the reflected image is minimized as perceived by a viewer when the reflective sighting device is subjected to small unwanted movement.

23 Claims, 6 Drawing Sheets

REFLECTIVE DOT SIGHTING DEVICE WITH PERCEIVED DOT LOCATION

RELATED APPLICATIONS

This application claims the benefit of U.S. Provisional Application No. 61/101,258 filed on Sep. 30, 2008.

BACKGROUND OF THE INVENTION

This invention relates generally to sighting devices for archery bows, cross bows, firearms, or other projectile launching devices, and more particularly to a reflective-type sighting device having a perceived dot location for creating stability of dot movement during aiming.

Reflex sights typically include a partially reflective lens and a battery-powered light source that projects light onto the reflective lens to define a reflex dot which is superimposed on a target as viewed through the lens. Typically, the reflected dot is arranged so that it is in focus with the distant target. However, such an arrangement can cause excessive movement of the reflected dot with respect to the target when slight movement is made with the particular projectile launching device to which the sight is mounted. Accordingly, it can be quite difficult to maintain a steady fix on the distant target while aiming.

SUMMARY OF THE INVENTION

In accordance with one aspect of the invention, a reflective sighting device includes a reflective sight component having a reflective surface for facing a user and a light source arranged for projecting a reflected image onto the reflective sight component for view by the user along a line of sight. A first focal plane of the reflected image is closer to the reflective sight component than a second focal plane of a distant target, so that movement of the reflected image is minimized as perceived by a viewer when the reflective sighting device is subjected to small unwanted movement.

In accordance with a further aspect of the invention, a reflective sighting device includes a reflective sight component having a reflective surface for facing a user, and a light source arranged for projecting a reflected image onto the reflective sight component for view by the user along a line of sight. The reflective sight component extends along a first axis and is tilted at a first acute angle with respect to the line of sight.

In accordance with yet a further aspect of the invention, a method of sighting in a distant target includes: locating a target at a first focal plane; providing a reflective sighting device with a reflective dot at a second focal plane; and superimposing the reflective dot on the target. The second focal plane is closer to a user than the first focal plane so that movement of the reflective dot is minimized as perceived by a viewer when the reflective sighting device is subjected to small unwanted movement.

BRIEF DESCRIPTION OF THE DRAWINGS

The following detailed description of the preferred embodiments of the present invention will be best understood when considered in conjunction with the accompanying drawings, wherein like designations denote like elements throughout the drawings, and wherein.

It is noted that the drawings are intended to depict exemplary embodiments of the invention and therefore should not be considered as limiting the scope thereof. It is further noted that the drawings are not necessarily to scale. The invention will now be described in greater detail with reference to the accompanying drawings.

DETAILED DESCRIPTION OF THE INVENTION

Figure 1:
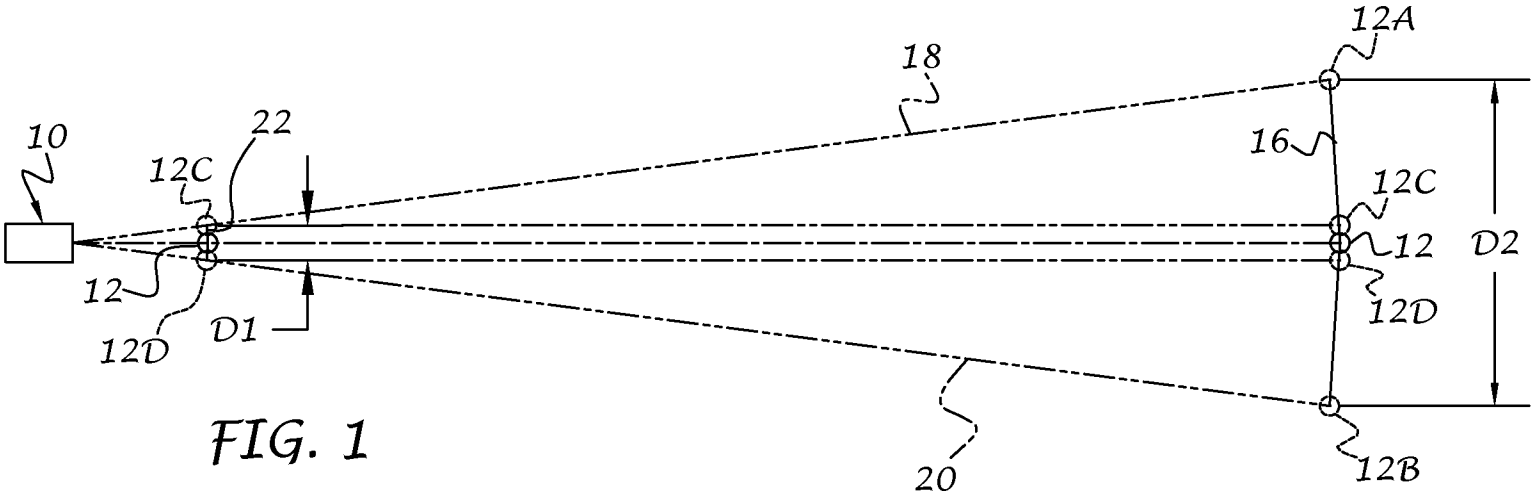
FIG. 1 is a top diagrammatic view of a reflective dot projection and movement illustrating differences in reflective dot location of the prior art and the present invention.
Figure 2:
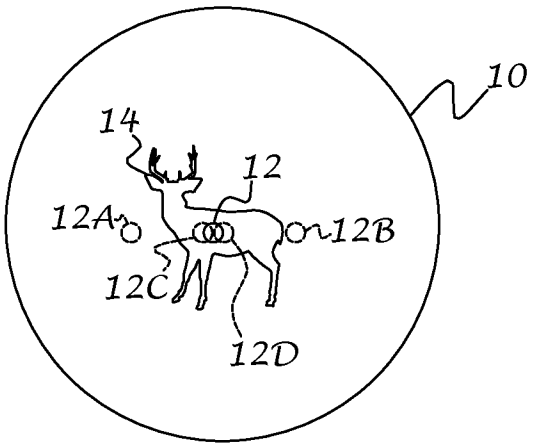
FIG. 2 is a front elevational diagrammatic view of a reflective dot projection and movement illustrating differences in reflective dot location of the prior art and the present invention.

Referring to the drawings, and to FIGS. 1 and 2 in particular, a reflective sighting device 10 in accordance with the present invention is arranged to superimpose an illuminated dot 12 on a distant target 14 when a user (not shown) is in an aiming position. In prior art sighting devices, the dot 12 is in the same focal plane (or at the same focal distance) 16 as the target 14. Slight movement of the sighting device, as represented by phantom lines 18 and 20, results in excessive movement of the dot 12, as represented by dots 12A and 12B, over a relatively large distance D2. Although slight movement of the sighting device 10 may be almost imperceptible to the user, the resultant excessive movement of the dot 12 is readily noticed. Since the dot's movement is greatly magnified, it may be difficult for the user to steady the dot on the intended target. This effect is further augmented when the sighting device 10 is mounted on a bow where other factors contribute to the unsteadiness of the dot 12, including bow weight, draw forces acting on the user when in an aiming position, as well as the user's strength and ability to steady the bow when in the drawn position.

In accordance with one aspect of the present invention, the focal plane (or focal distance) 22 of a superimposed reflective dot 12 is preferably closer to the user than the focal plane (or focal distance) 16 of the target 14. In this manner, slight movement of the sight 10 results in less movement of the dot 12, as represented by dots 12C and 12D, over a relatively small distance D1. Accordingly, the present invention facilitates the user's ability to steady the reflective dot 12 on a distant target during aiming to thereby increase shooting accuracy.

Referring now to FIGS. 3-9, a reflective dot sighting device 10 in accordance with the present invention is illustrated. The sighting device 10, as shown throughout the drawings, is embodied as a bowsight. To this end, the sighting device 10 preferably includes a base member 32 with a bracket assembly 34 and a sight assembly 36 connected to the base member 32. The bracket assembly 34 is useful for attaching the sight assembly to a bow (not shown) or the like. However, it will be understood that the sighting device 10 may be adapted for use with any projectile launching device such as a rifle, pellet gun, BB gun, pistol, paint marker, and the like, and can be used with other devices, such as telescopes, sighting scopes, and so on, in order to quickly align the device with a distal target or scene.

The bracket assembly 34 includes a mounting bracket 38 that is preferably connected to the base member 32 via a first adjustment mechanism 40 for rotatably adjusting the vertical position of the sight assembly 36. Likewise, the sight assembly 36 is preferably connected to the base member 32 via a second adjustment mechanism 42 for adjusting both the lateral and vertical positions of the sight assembly 36. By way of example, it may be necessary to adjust the lateral position of the sight assembly 36 when used during windy conditions. Likewise, vertical adjustment of the entire sight assembly 36 may be needed when initially calibrating the sighting device 10 with a particular bow or other device, when changing from one arrow type to another, when shooting from different heights, such as from the ground or a tree stand, and so on.

The mounting bracket 38 preferably has a pair of vertically spaced openings 44 (FIG. 3) for receiving fasteners (not shown) or the like to mount the sighting device 10 to a bow (not shown) in a conventional manner. A vertically extending guide slot 45 is formed at a rear section of the bracket 38 for a purpose to be described in greater detail below.

Figure 5:
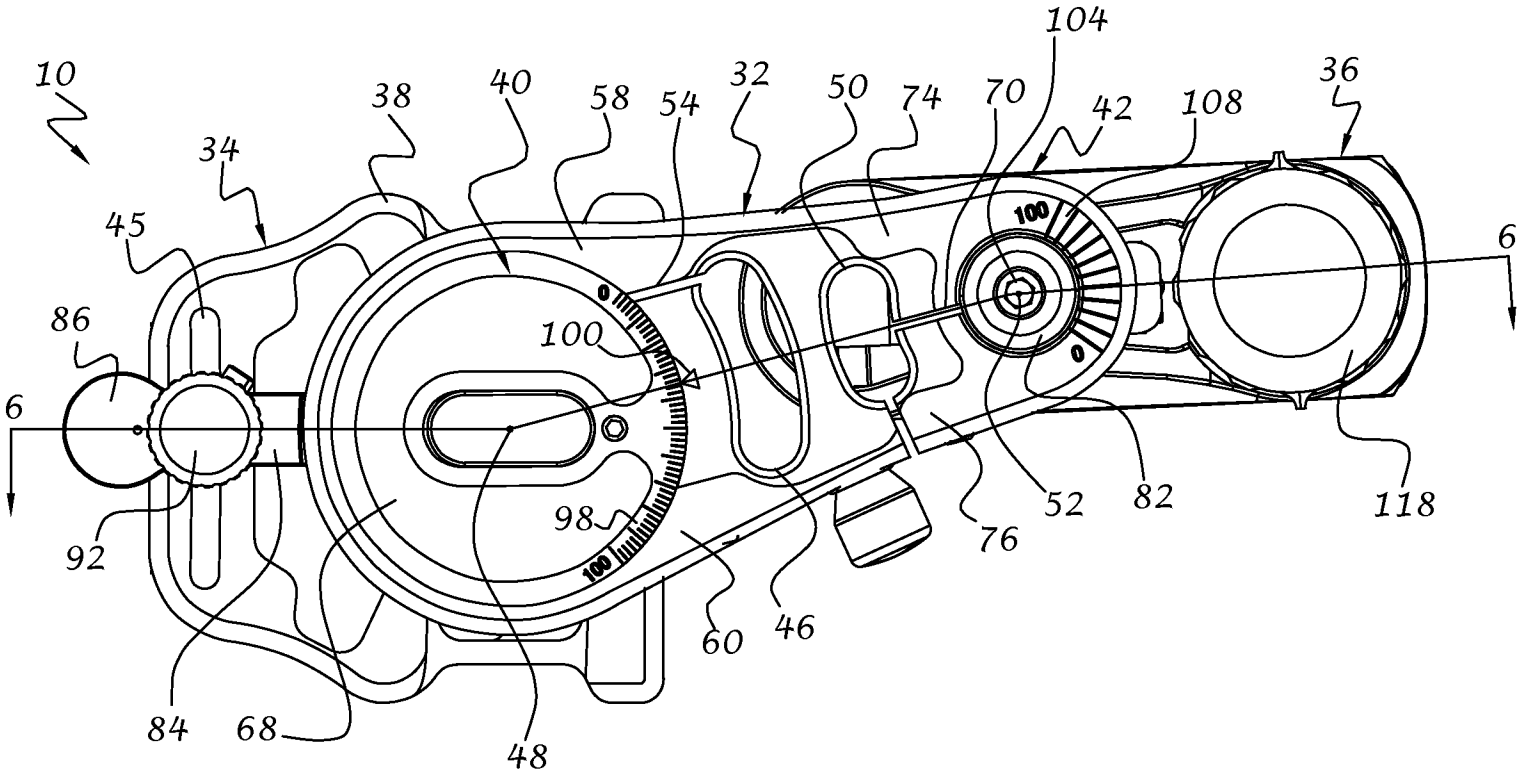
FIG. 5 is a side elevational view thereof.

As best shown in FIG. 5, the base member 32 preferably includes a first arcuate opening 46 concentric with a first pivot axis 48 of the first adjustment mechanism 40 and a second arcuate opening 50 concentric with a second pivot axis 52 of the second adjustment mechanism 42. A first adjustment slot 54 extends rearwardly from the first arcuate opening 46 and intersects with a rear opening 56 (FIG. 6) to thereby form a first pair of rearwardly extending clamping jaws 58, 60. A bolt 62 (FIG. 4) extends through an opening 64 in the jaw 58 and into a threaded opening 66 (FIG. 6) of the jaw 60. Preferably, rotation of the bolt 62 in a clockwise direction draws the jaws toward each other to clamp an adjustment disk 68 of the first adjustment mechanism 40 at a desired angular position while rotation of the bolt in a counter-clockwise direction causes the jaws to move away from each other for adjusting the position of the base member 32 with respect to the disk 68.

A second adjustment slot 70 (FIG. 5) extends forwardly from the second arcuate opening 50 and intersects with a front opening 72 (FIG. 6) to thereby form a second pair of rearwardly extending clamping jaws 74, 76. A bolt 78 (FIG. 4) extends through an opening 80 in the jaw 58 and into a threaded opening 82 (FIG. 6) of the jaw 76. Preferably, rotation of the bolt 78 in a clockwise direction draws the jaws 74, 76 toward each other to clamp around a tubular adjustment member 83 of the second adjustment mechanism 42 at a desired position while rotation of the bolt in a counter-clockwise direction causes the jaws to move away from each other for adjusting the angular and linear position of the tubular adjustment member 83 with respect to the base member 32.

The first adjustment mechanism 40 also preferably includes a lever arm 84 connected to the adjustment disk 68 for rotation therewith. The lever arm 84 extends rearwardly from the adjustment disk 68 and terminates in an enlarged head 86 that can be manipulated by a user during adjustment. A pointer 88 (FIG. 3) extends laterally from the head 86 and rides along a flat rearward surface 90 of the bracket 38. Indicia (not shown) can be positioned along the surface 90 to inform the user of an adjustment position. A locking knob 92 is mounted to the lever arm 84 via a threaded fastener 94 that extends through both the lever arm 84 and the guide slot 45. A head 96 of the fastener 94 is located within the guide slot such that rotation of the knob 92 in a clockwise direction locks the lever arm 84, and thus the adjustment disk 68, against movement. Likewise, loosening of the knob 92 in a counter-clockwise direction enables a user to adjust the position of the disk 68, and thus the vertical position of the sight assembly 36 with respect to the bracket 38. Indicia 98 can be located on the disk 68 while a corresponding pointer 100 can be located on the base member 32 in order to ascertain the adjustment position.

The second adjustment mechanism 42 preferably includes the tubular adjustment member 83 with a base 102 (FIG. 6), and a bolt 104 that extends through the base 102 of the tubular member and threads into the sight assembly 36 to thereby secure the sight assembly to the tubular member, and thus to the base member 32 when the jaws 74, 76 are tightened around the tubular member 83 as previously described. A windage scale 106 (FIG. 4) is preferably provided on the tubular member 83 for ascertaining lateral adjustment of the tubular member 83, and thus a lateral position of the sight assembly 36 with respect to the base member 32. Likewise, indicia 108 is preferably located on the base member 32 and a corresponding line or indicator 110 (FIG. 4) is located on the tubular member 83 in order to ascertain an angular adjustment position of the sight assembly 36. Preferably, the indicia 98 and indicia 108 begin and terminate at opposite ends of the scale so that the sight assembly can be leveled with greater facility with respect to a user.

By way of example, it may be necessary to adjust the lateral position of the sight assembly 36 when used during windy conditions and/or when calibrating the sight device 10. Likewise, vertical and horizontal adjustment of the entire sight assembly 36 may be needed when initially calibrating the sighting device 10 with a particular bow (or other device) and arrow (or other projectile), when shooting from different distances and/or heights, such as from the ground or a tree stand, and so on. In use, the user may wish to adjust the vertical height of the sight assembly 36 through manipulation of the first adjustment mechanism by loosening the knob 92 and applying force to the lever arm 84 to move the sight assembly upward or downward. Additional vertical adjustment is achieved by loosening the clamping jaws 58, 60 by turning the screw 62 counter clockwise and rotating the base member 32 with respect to the disk 68. Since vertical adjustment is caused by a rotating motion, the sight assembly may be oriented at an angle with respect to the bracket 38 to a position where the reflective dot cannot be viewed or is not properly positioned with respect to a user's line of sight. Accordingly, the second adjustment mechanism can be manipulated by loosening the clamping jaws 74, 76 and rotating the tubular member 83 until the sight assembly 36 is oriented in the line of sight.

Figure 3:
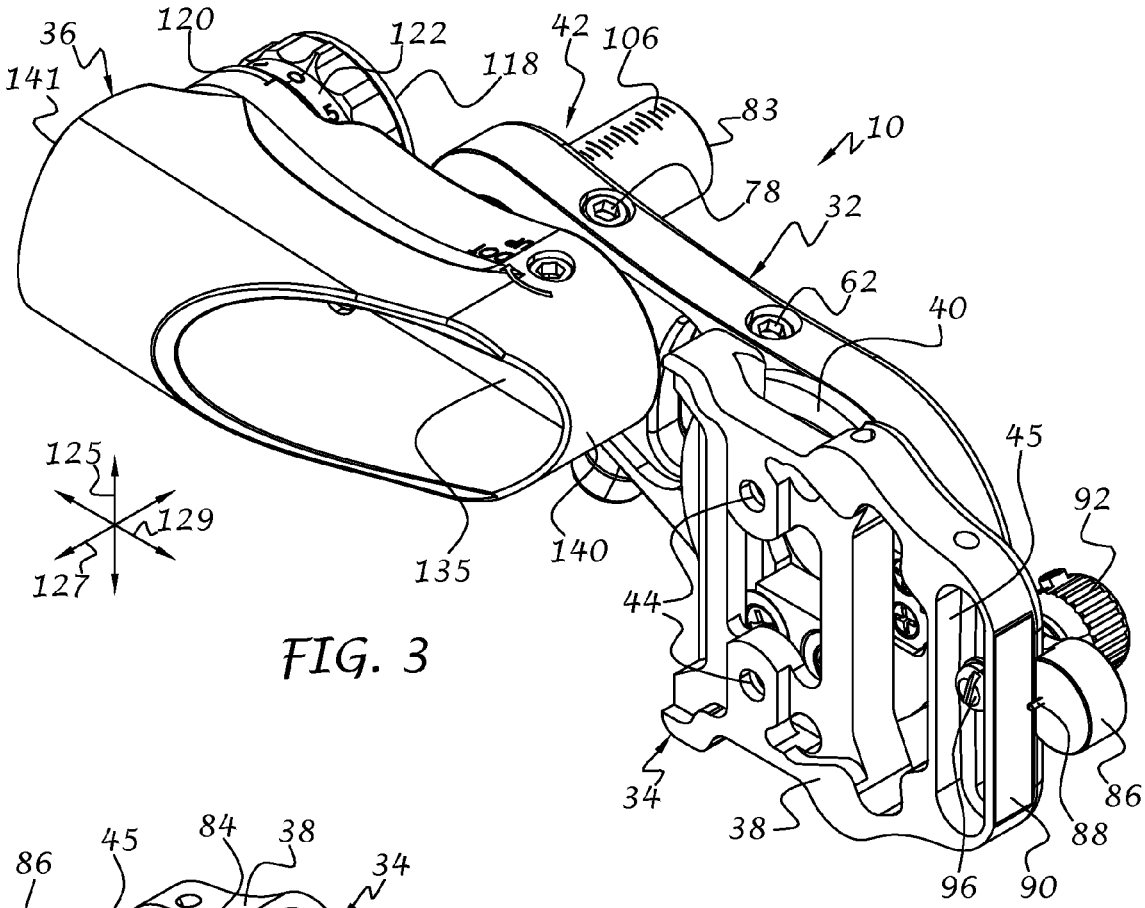
FIG. 3 is a rear perspective view of a reflective dot sighting device in accordance with the present invention.
Figure 4:
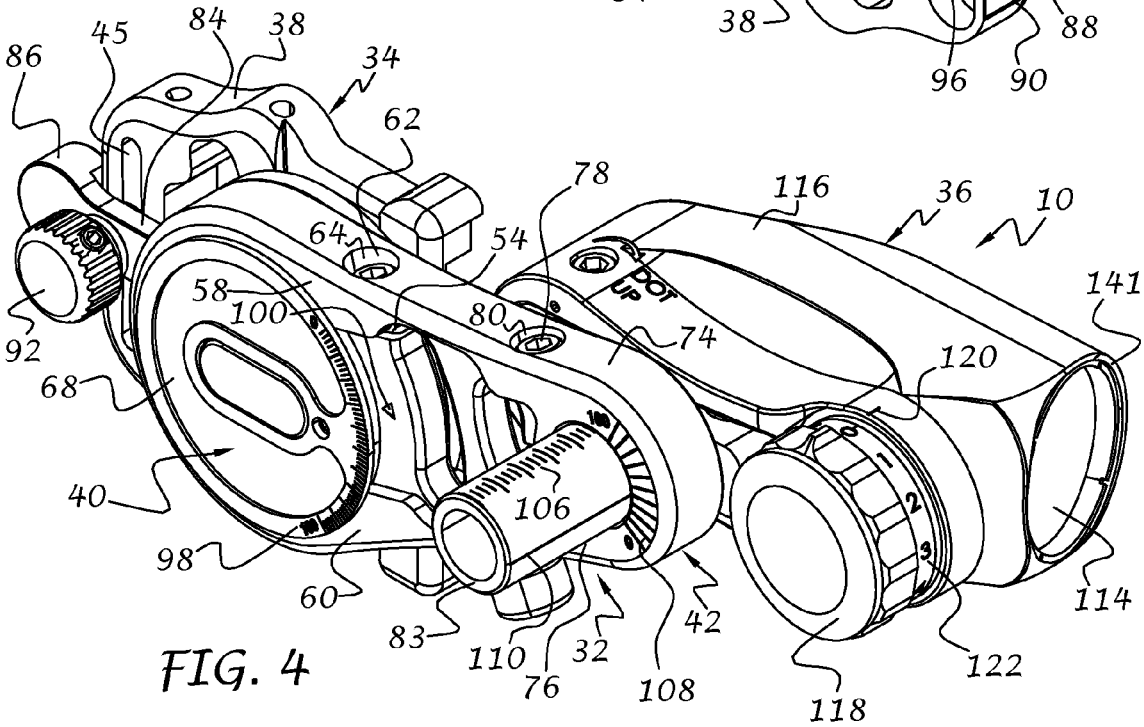
FIG. 4 is a front perspective view thereof.
Figure 6:
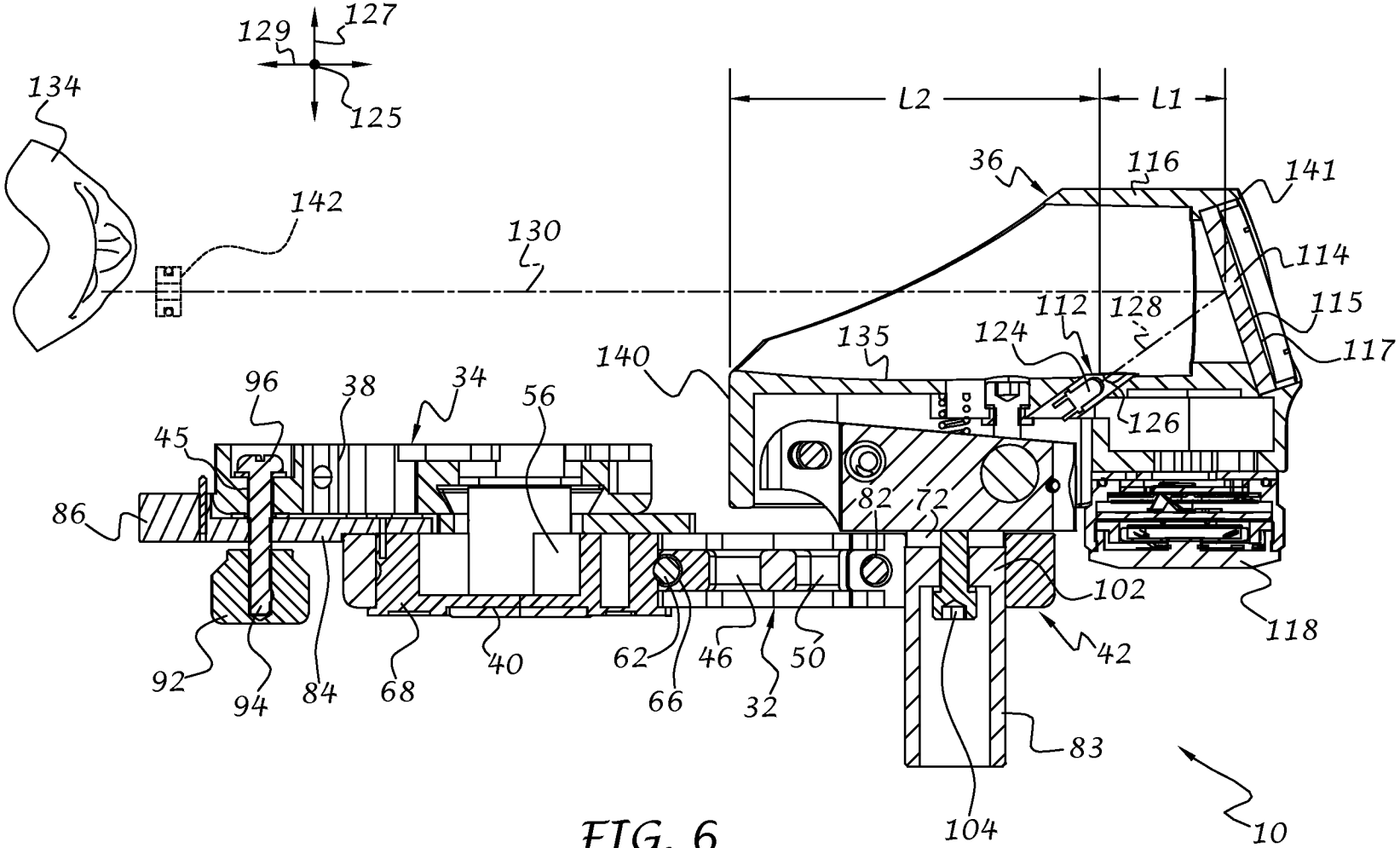
FIG. 6 is a longitudinal sectional view of the reflective dot sighting device taken along line 6-6 of FIG. 5.
Figure 7:
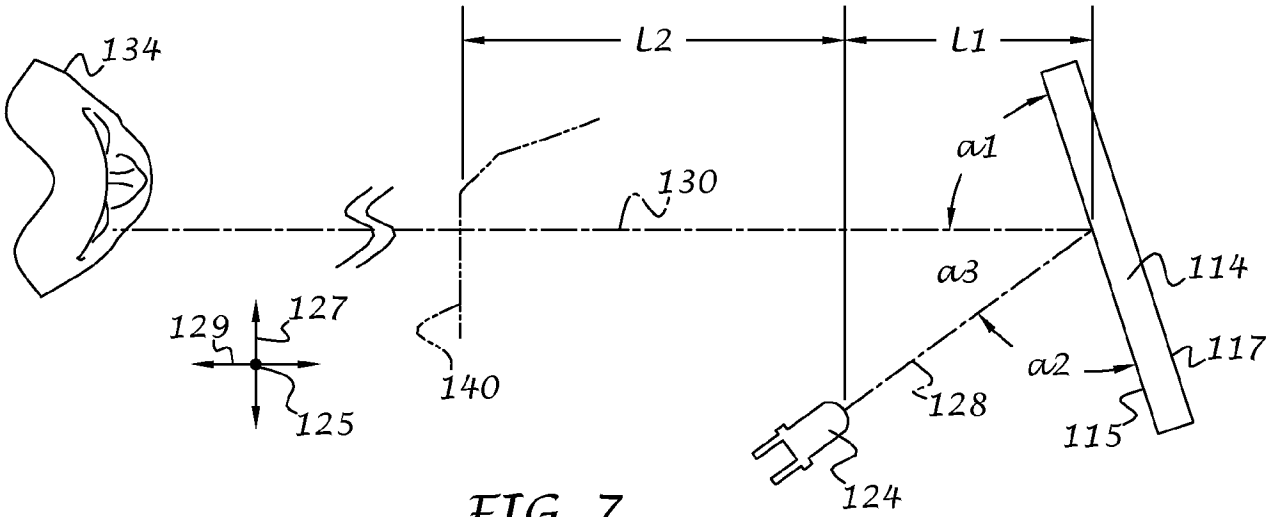
FIG. 7 is a top schematic view of the relative orientation between the light source and lens of the reflective dot sighting device with respect to a user's line of sight.

As shown in FIGS. 3, 6 and 7, the sight assembly 36 will be best understood with reference to a 3-axis coordinate system having a first axis 125, a second axis 127 extending perpendicular to the first axis 125, and a third axis 129 extending perpendicular to the first and second axes. The first axis 125 extends generally vertically while the second axes 127 and 129 extend in a generally horizontal plane. However, it will be understood that these terms are relative since the sight assembly 36 may be tilted at other orientations with respect to true vertical and horizontal coordinates during use, especially since different users may exhibit different aiming stances.

The sight assembly 36 preferably includes an image generating portion 112 (FIG. 6) and a reflective sight component 114 mounted within a tubular sight frame 116. The reflective sight component has a reflective surface 115 and/or 117 that is adapted to face a user when in use. An adjustment knob 118 is connected to the sight frame 116 and is arranged to rotate clockwise or counterclockwise to adjust the luminous intensity of an image incident on the reflective sight component 114 to accommodate a user over a wide range of ambient light conditions. The knob 118 is preferably arranged to have detent positions so that discrete levels of luminous intensity can be selected. The knob can also be provided with an "off" position when the sighting device 10 is not in use. To that end, an alignment mark 120 (FIG. 4) may be provided on the frame 116 and suitable marks 122 may be provided on the knob 118 to indicate the different luminous intensity levels as well as the "off" position. In accordance with a further embodiment, the knob 118 may be replaced with an ambient light sensor so that the luminous intensity can be automatically adjusted. With this arrangement, a separate on/off switch may be provided either as a user manipulated device or as a tilt sensor or the like with an electronic timer for automatically turning on/off the sighting device.

As best shown in FIG. 6, the image generating portion 112 preferably includes a light source 124 and a reticle 126 located adjacent to and in alignment with the light source. Light from the light source 124 is projected through the reticle 126 and onto the reflective sight component 114, as represented by projection line 128 (shown in phantom line), which is in turn reflected toward the user along a user line of sight 130 (shown in phantom line), which is preferably coincident with a central axis of the tubular sight frame 116 and the third axis 129 of the 3-axis coordinate system. The projection line 128 is preferably located in a plane defined by the second axis 127 and third axis 129 so that the line of sight lies in the same plane as the light source 124. However, it will be understood that the light source can be tilted upward or downward out of the plane. In addition, the particular image or sight pattern incident on the reflective sight component 114 as viewed by the user depends on the type of reticle used. Accordingly, it will be understood that the term "dot" as used herein refers not only to circular images but to cross-hairs, circles, triangles, and/or any other convenient shape for designating a distant target.

The reflective sight component 114 is preferably in the form of a flat lens mounted in a forward end 141 of the sight frame 116 through well-known attachment means. The lens 114 preferably extends parallel to the first axis 125 and is oriented at a first angle a1 with respect to the line of sight or the third axis 129. The lens 114 is preferably constructed of a transparent material, such as glass, plastic or the like and includes a well-known reflective coating on one or both surfaces 115, 117 so that the user can see both the reflected dot image from the light source 124 at one or more predetermined wavelengths and the distant scene or target through the lens 114. Although the lens 114 is shown as a generally flat disk, it will be understood that it may be curved and/or used in conjunction with other coatings, lenses, and/or lens configurations to produce a particular visual effect and/or to reduce or prevent unwanted visual effects as is well known.

The light source 124 is preferably in the form of a light emitting diode (LED) that emits radiant energy in the visible light region of the electromagnetic spectrum so that the resultant reflected image is visible to the naked eye. However, it will be understood that near infrared or other wavelengths may be used when accompanied by other viewing equipment, such as night vision devices. It will be further understood that other light sources can be used, such as dual-color or tri-color LED's to give the user a selectable color choice for the reflected image, incandescent bulbs, laser diodes, fluorescent-doped fiber optics, tritium lights, combinations thereof, and so on.

Referring to FIGS. 6 and 7, the light source 124, reticle 126 and lens 114 are preferably arranged and oriented so that a perceived focal point of the reflected dot 12 is nearer to the user 134 than the focal point of the distant target, as shown in FIGS. 1 and 2. In order to achieve this effect, the light source 124 is preferably located at a first distance L1 from the lens 114 and at a second distance L2 from a rear end 140 of the sight frame 116 (represented by phantom line in FIG. 7), where the distance L1 is much smaller than the distance L2. Since the light source 124 is much closer to the lens 114 than prior art devices, the lens preferably extends parallel to or along the first axis 125 at a first acute angle a1 with respect to the line of sight 130 (third axis 129) and at a second acute angle a2 with respect to the projection line 128 of the light source 124. In addition, the projection line 128 of the light source 124 extends at a third acute angle a3 with respect to the line of sight 130. Preferably, the angles a1 and a2 are congruent and each is larger than the angle a3. The angles a1 and a2 are each preferably twice as large as angle a3. In this manner, the shooter doesn't see his or her own reflection or other distracting reflections on the lens 114. In accordance with an exemplary embodiment of the invention, angles a1 and a2 are approximately 72 degrees and angle a3 is approximately 36 degrees. However, it will be understood that the values of angles a1, a2 and a3 can vary without departing from the spirit and scope of the invention.

With this arrangement, the focal plane of the dot 12 (FIGS. 1 & 8) is closer than the focal plane of the target 14. When the lens 114 is flat, the focal plane of the dot 12 is at the lens. Accordingly, slight movement of the sight 10 and the bow or other device to which it is attached, results in less movement of the reflective dot over a relatively small distance when compared to the prior art. Thus, the present invention facilitates the user's ability to steady the reflective dot on a distant target during aiming to thereby increase shooting accuracy. The present invention also reduces the amount of time needed by the user to acquire the reflective dot in the field of view. In regular red dot sights of the prior art, the sighting dot can be positioned practically anywhere on the lens as viewed by the user without changing the accuracy of the shot since the focal plane of the dot is at the target. However, since the focal plane of the dot 12 of the present invention is at or near the lens 114, the dot 12 should be located consistently at the center of the lens (or consistently at another location on the lens) for better aiming accuracy. Accordingly, depending on the particular skill and consistency (or the lack thereof) of a user during aiming and shooting, a rear sight 142 (shown in broken line in FIG. 6) can be used in conjunction with the reflective sighting device 10. Although the rear sight 142 is shown as a peep sight, it will be understood that other rear sights for bows and firearms can be used.

At least one inner side wall 135 of the sight frame 116 is preferably covered with a non-reflective tape or coating to reduce unwanted reflections on the lens. However, it will be understood that the entire inner surface of the sight frame 116 can be constructed of or covered with or formed of one or more materials having non-reflective properties.

Figure 10:
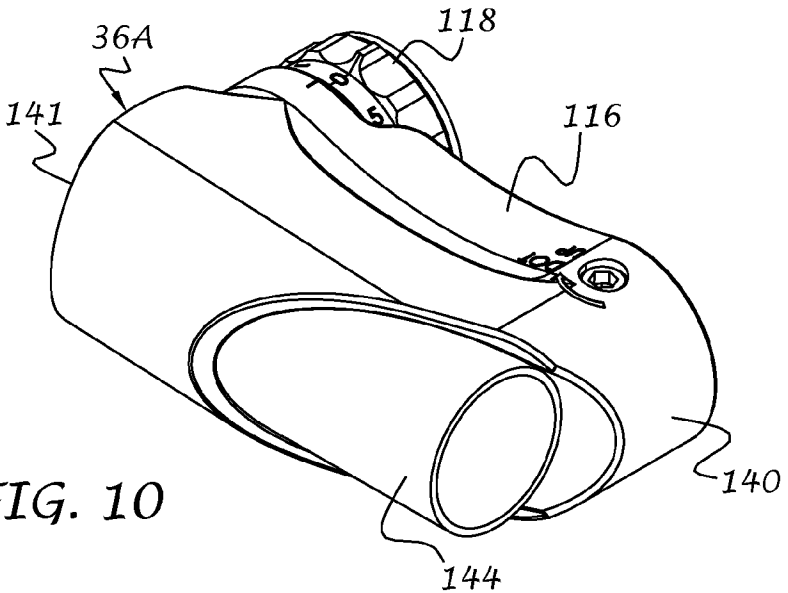
FIG. 10 is a rear perspective view of a reflective dot sighting device in accordance with a further embodiment of the invention.
Figure 8:
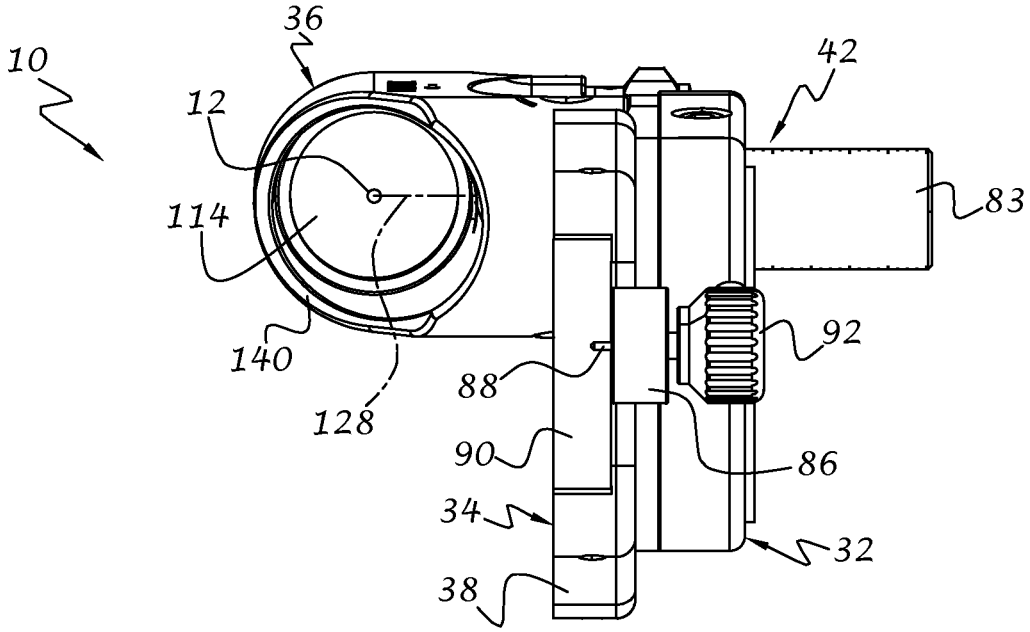
FIG. 8 is a rear elevational view of the reflective dot sighting device in accordance with the present invention.
Figure 9:
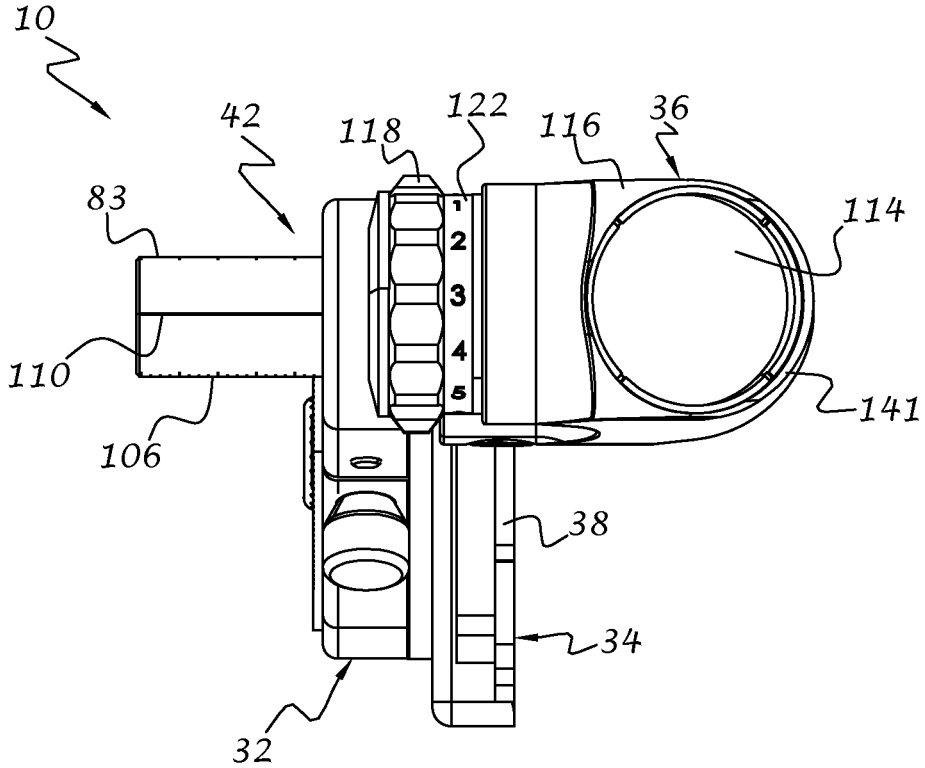
FIG. 9 is a front elevational view thereof.

Referring to FIG. 10, and in accordance with a further embodiment of the invention, a tubular insert 144 with non-reflective properties is installed in the sight frame 116 to reduce unwanted reflections on the lens. The insert 144 can be permanently installed or removable for accommodating various ambient light conditions.

It will be understood that the term "preferably" as used throughout the specification refers to one or more exemplary embodiments of the invention and therefore is not to be interpreted in any limiting sense. In addition, terms of orientation and/or position as may be used throughout the specification denote relative, rather than absolute orientations and/or positions.

It will be appreciated by those skilled in the art that changes could be made to the embodiments described above without departing from the broad inventive concept thereof. It will be understood, therefore, that this invention is not limited to the particular embodiments disclosed, but also covers modifications within the spirit and scope of the present invention as defined by the appended claims.

We claim:

1. A reflective sighting device comprising:

a sight frame having a front end and a rear end and being adapted for connection to a mounting bracket;

a reflective sight component connected at least proximal to the front end of the sight frame and having a planar reflective surface for facing a user, the planar reflective surface being oriented at a first acute angle with respect to a line of sight between the reflective sight component and the user; and a light source connected at least proximal to the front end of the frame and having a light projection line oriented at a second acute angle with respect to the reflective sight component for projecting an aiming image onto the reflective sight component, and reflecting the aiming image for a perceived view by the user along the line of sight, the light source being closer to the reflective sight component than to the rear end of the sight frame along the line of sight;

wherein the aiming image is perceived by the user as being closer to the user than an expected target distance, so that lateral movement of the reflected aiming image is minimized as perceived by the user when the reflective sighting device is subjected to movement with respect to the user during aiming.

2. A reflective sighting device according to claim 1, wherein the reflected sight image remains steady in a center of the reflective sight component during relative movement between the reflective sighting device and the user.

3. A reflective sighting device according to claim 1, wherein the reflected aiming image is perceived to be in focus at a position coincident with the planar reflective surface.

4. A reflective sighting device according to claim 1, wherein the reflective sight component extends along a first axis perpendicular to the line of sight.

5. A reflective sighting device according to claim 1, wherein the light projection line and the line of sight lie in a single horizontal plane.

6. A reflective sighting device according to claim 1, wherein the first and second acute angles are greater than a third acute angle between the light projection line and the line of sight.

7. A reflective sighting device according to claim 6, wherein the first and second acute angles are equal and approximately twice as large as the third acute angle.

8. A reflective sighting device according to claim 1, and further comprising a separate rear sight in visual alignment with the aiming image of the reflective sight component for consistently positioning the reflective sighting device with respect to the distant target.

9. A reflective sighting device according to claim 8, wherein the rear sight comprises a peep sight.

10. A reflective sighting device comprising:

a reflective sight component having a planar reflective surface for facing a user, the reflective sight component being oriented at a first acute angle with respect to a line of sight between the reflective sight component and the user;

a light source arranged for projecting a reflected aiming image onto the reflective sight component for view by the user along the line of sight and having a light projection line oriented at a second acute angle with respect to the reflective sight component, the light projection line and the line of sight being oriented at a third acute angle, with the first, second and third acute angles lying in a single plane; and a sight frame having a front end and a rear end, with the light source and the reflective surface being connected at least proximal to the front end of the sight frame;

wherein a first distance along the line of sight between the light source and the reflective sight component is less than a second distance along the line of sight between the light source and the rear end, such that the reflected aiming image is perceived by the user as being closer to the user than an expected target distance, so that lateral movement of the reflected aiming image is minimized as perceived by the user when the reflective sighting device is subjected to movement with respect to the user during aiming.

11. A reflective sighting device according to claim 10, wherein the reflected sight image remains steady in a center of the reflective sight component during relative movement between the reflective sighting device and the user.

12. A reflective sighting device according to claim 10, wherein a first focal plane of the reflected image is closer to the reflective sight component than a second focal plane of a distant target.

13. A reflective sighting device according to claim 12, wherein the reflected image appears to be in focus at a position coincident with the planar reflective surface.

14. A reflective sighting device according to claim 10, wherein the reflective sight component extends along a first axis that is located in a plane perpendicular to the line of sight.

15. A reflective sighting device according to claim 14, wherein the light projection line and the line of sight lie in a single horizontal plane.

16. A reflective sighting device according to claim 14, wherein the first and second acute angles are greater than the third acute angle.

17. A reflective sighting device according to claim 16, wherein the first and second acute angles are equal and approximately twice as large as the third acute angle.

18. A reflective sighting device according to claim 10, and further comprising a separate rear sight in visual alignment with the reflective sight component for consistently positioning the reflective sighting device.

19. A reflective sighting device according to claim 18, wherein the rear sight comprises a peep sight.

20. A method of sighting in a distant target, comprising:

locating a target at a first focal plane;

providing a reflective sighting device with a reflective dot at a second focal plane;

providing the reflective sighting device with a sight frame having a front end and a rear end;

locating a light source and a reflective surface proximal to the front end of the sight frame, such that a first distance along a line of sight between the light source and the reflective surface is less than a second distance along the line of sight between the light source and the rear end of the sight frame; and superimposing the reflective dot on the target;

wherein the second focal plane is closer to a user than the first focal plane so that the reflective dot is perceived by the user as being much closer to the user than an expected target distance, so that movement of the reflective dot is minimized as perceived by the user when the reflective sighting device is subjected to small unwanted movement with respect to the user.

21. A method according to claim 20, wherein the reflected dot is held steady in a center of the reflective surface during relative movement between the reflective sighting device and the user.

22. A method according to claim 20, and further comprising:

sighting the reflective dot through a separate rear sight for consistently positioning the reflective sighting device.

23. A method according to claim 22, wherein the rear sight comprises a peep sight.

* * * * *